US005597793A

United States Patent [19]

Besse et al.

[11] Patent Number: 5,597,793

[45] Date of Patent: Jan. 28, 1997

[54] ADHERENT FOAM CLEANING COMPOSITIONS

[75] Inventors: Michael Besse, Golden Valley; Timothy Gutzmann, Eagan; Roger Keppers, St. Paul; Richard Ruhr, Buffalo, all of Minn.

[73] Assignee: Ecolab Inc., St. Paul, Minn.

[21] Appl. No.: 339,568

[22] Filed: Nov. 15, 1994

Related U.S. Application Data

[63] Continuation-in-part of Ser. No. 69,601, Jun. 1, 1993, abandoned.

[51] Int. Cl.[6] ..... C11D 3/37; C11D 3/48; C11D 11/00; C11D 17/00

[52] U.S. Cl. ..... 510/434; 510/370; 510/379; 510/383; 510/406; 510/417; 510/435

[58] Field of Search ..... 252/174.24, 174.23, 252/DIG. 2, 156, 174, 89.1; 510/383–386, 406, 417, 434, 435, 476, 370, 379–381

[56] References Cited

U.S. PATENT DOCUMENTS

| | | | |
|---|---|---|---|
| 3,578,499 | 5/1971 | Crotty et al. | 134/4 |
| 3,591,416 | 7/1971 | Johnson et al. | 134/2 |
| 3,625,854 | 12/1971 | Gower et al. | 252/171 |
| 3,671,440 | 6/1972 | Sabatelli et al. | 252/103 |
| 3,718,609 | 2/1973 | Weimer | 252/545 |
| 3,779,933 | 12/1973 | Eisen | 252/118 |
| 3,808,051 | 4/1974 | Schoenholz et al. | 134/2 |
| 3,839,234 | 10/1974 | Roscoe | 252/544 |
| 4,077,896 | 3/1978 | Bunegar et al. | 252/90 |
| 4,135,947 | 1/1979 | Rink | 134/4 |
| 4,228,048 | 10/1980 | Tesdahl | 260/17.4 |
| 4,255,294 | 3/1981 | Rudy et al. | 252/524 |
| 4,329,237 | 5/1982 | Wixon | 252/8.75 |
| 4,415,489 | 11/1983 | Kiczek et al. | 252/558 |
| 4,445,521 | 5/1984 | Grollier et al. | 132/7 |
| 4,477,365 | 10/1984 | Verboom et al. | 252/156 |
| 4,512,908 | 4/1985 | Heile | 252/160 |
| 4,599,186 | 7/1986 | Choy et al. | 252/102 |
| 4,619,711 | 10/1986 | Olbrueck et al. | 134/38 |
| 4,657,690 | 4/1987 | Grollier et al. | 252/90 |
| 4,657,692 | 4/1987 | Choy et al. | 252/99 |
| 4,692,276 | 9/1987 | Schramm | 252/545 |
| 4,751,009 | 6/1988 | Damaso et al. | 252/8.75 |
| 4,800,036 | 1/1989 | Rose et al. | 252/102 |
| 4,880,557 | 11/1989 | Ohara et al. | 252/174.15 |
| 4,915,865 | 4/1990 | Westermann et al. | 252/157 |
| 4,965,019 | 10/1990 | Schmid et al. | 252/231 |
| 4,992,194 | 2/1991 | Liberati et al. | 252/99 |
| 5,051,401 | 9/1991 | Sikes | 514/7 |
| 5,102,573 | 4/1992 | Han et al. | 252/153 |
| 5,234,505 | 8/1993 | Winston et al. | 134/40 |
| 5,399,285 | 3/1995 | Kanluen | 252/174.23 |

FOREIGN PATENT DOCUMENTS

| | | |
|---|---|---|
| 0072158 | 2/1983 | European Pat. Off. . |
| 0379093 | 7/1990 | European Pat. Off. . |
| 0393772 | 10/1990 | European Pat. Off. . |
| 0595590A2 | 5/1994 | European Pat. Off. . |
| 2413122 | 10/1974 | Germany . |
| 59-138298 | 8/1984 | Japan . |
| 3-278876 | 12/1991 | Japan . |
| 1220069 | 1/1971 | United Kingdom . |
| 2160887 | 6/1984 | United Kingdom . |

OTHER PUBLICATIONS

Super Foamer Model 2S, Installation and Operation Manual (1991). (no mo. available).

Model K Foamer HP & LP/SP, Installation and Operation Manual (1991). (no mo. available).

Acusol™ 820 Associative Thickener, For Use In Household and Industrial Cleaners Nov. 1990.

Acusol Detergent Polymers, Physical Properties and General Application Apr. 1991.

Acusol™ 810 Acrylic Thickener–Stabilizer (1990). (no mo. available).

Acusol™ 840 Acrylic Thickener–Stabilizer (1990). (no mo. available).

Acusol™ 810 Thickener, Feb. 1, 1991.

Himangshu S. Bose, Indian Journal of Chemistry, *Interaction of Some Thiazine Dyes with Sodium Polystyrene Sulphonate in Presence of Alkali Metal Halides, Quaternary Ammonium Salts & Surfactants*, vol. 26A, pp. 862–864 (1987).

Janina Rodakiewicz–Nowak, Journal of Colloid and Interface Science, *Surface Characteristics of Some Anionic, Cationic and Anionic–Cationic Surfactants*, vol. 84, No. 2, pp. 532–535 (1981).

Dewey L. Smith et al., J. Am. Oil Chem. Soc., *The Interaction of Dimethyl Ditallow Ammonium Chloride and Sodium Linear Alkylbenzene Sulfonate*, vol. 66, No. 5, pp. 718–727 (1989).

Acusol Thickeners for Detergents, 1990 (no mo. available).

*Primary Examiner*—Ardith Hertzog

*Attorney, Agent, or Firm*—Merchant, Gould, Smith, Edell Welter & Schmidt

[57] ABSTRACT

The invention is a foam stabilizing composition which is used in conjunction with alkaline detergent products to produce a foam which is capable of clinging to vertical surfaces for extended time periods without breakdown or drying and which ultimately rinses freely with water. The foam stabilizing composition generally comprises a vinyl polymer emulsion. The invention also comprises a method of cleaning hard surfaces using the combination of the alkaline detergent product and the disclosed foam stabilizing composition.

22 Claims, No Drawings

ADHERENT FOAM CLEANING COMPOSITIONS

CROSS-REFERENCE TO RELATION APPLICATION

This application is a continuation-in-part of application Ser. No. 08/069,601 filed Jun. 1, 1993, now abandoned.

FIELD OF THE INVENTION

The invention generally relates to alkaline surface cleaning compositions. More specifically, the invention relates to compositions and methods for improving alkaline detergents by providing a stabilized adherent foam cleaning composition capable of remaining on vertical and horizontal surfaces for extended time periods and which also rinses freely with water.

BACKGROUND OF THE INVENTION

Surface cleaning in any given environment is generally undertaken to maintain hygiene by removing residues left on the surface. Cleaning prevents contamination of substances, articles, and utensils as well as any other animate or inanimate objects such as food which may come in contact with the surface. While certain residues merely comprise carbonaceous debris, this debris may often provide a host or starting point for the growth of bacteria, microorganics, or other contaminants.

Additionally, surfaces may also be cleaned to maintain their serviceability and mechanical integrity during operation. In any given industrial or commercial setting, surfaces such as walls, floors, countertops, as well as, ranges, grills, ovens, mixing tanks, storage racks, and the like may all present difficult surfaces to clean and disinfect. Such structures may all, from time to time, contain surfaces which retain large residual contamination which is difficult to clean. Further, given the extended use that such equipment is subjected to, repeated cleaning is an ongoing problem. However, the frequency of such cleaning generally requires a high level of efficiency with minimal expenditure of human resources in the form of time and manpower.

For example, cleaners such as those useful in ovens often work by application to the intended surface for extended periods of time. Current industrial detergents designed to be foam applied are capable of producing large levels of foam. However, when applied to soiled or cleaned vertical surfaces, for example, the foam begins to sag, collapse, and move toward the floor within minutes of application. Soil removal is often incomplete due to the limited contact time of the foam. As a result, repeated applications of the cleaner is often necessary. Another problem associated with current foaming detergents is the drying of the foam on the surface prior to rinsing. Premature drying may also require another detergent application to solubilize the remaining detergent residues and, ultimately, produce a clean, streak-free surface.

A number of cleaners have been developed for industrial and institutional surfaces. Gel compositions have been developed to clean and overcome the limited contact time between the detergent and soil associated with foam cleaning. These products utilize thickening agents to increase product to soil contact time in an attempt to improve soil removal. However, gel cleaners have some of the same limitations as foam cleaners including drying of the solution, poor rinseability, and poor visibility of the product once applied.

Past attempts at cleaning compositions include Verboom, U.S. Pat. No. 4,477,365, which discloses the use of a composition containing an alkaline metal hydroxide, betaine, alpha olefin sulfonate, and hydrotropic agent. Schoenholz, U.S. Pat. No. 3,808,051 discloses a cleaning composition comprising an alkali metal salt of a weak organic acid, and a polyhydric alcohol which is used at a temperature of 250°–550° F. Eisen, U.S. Pat. No. 3,779,933 discloses a composition comprising an alkali metal hydroxide incorporating a nitrogen containing anionic surfactant, a thickening agent, and, optionally, a foam forming agent. Rink, U.S. Pat. No. 4,135,947 discloses a water-based composition having a pH of less than 10 and comprising carbon dioxide, neutralized amines, water soluble solvents, and thickening agents. Heile, U.S. Pat. No. 4,512,908 discloses an alkaline detergent composition comprising a chlorine source along with synthetic hectoright thickeners.

Generally, these prior compositions teach the use of alkaline cleaning constituents in a gelled or foaming state for use in applications such as ovens.

However, to date, these compositions have not been able to overcome problems including a lack of ease in rinseability, requirements for repeated application, and overall efficacy. As a result, a need exists for a alkaline stabilized foam for hard surface cleaning which provides the overall stability and cleaning requirements which allow application to any number of given surfaces.

SUMMARY OF THE INVENTION

In accordance with a first aspect of the invention, there is provided a method of stabilizing alkaline cleaning compositions using a foam stabilizing additive which when combined with an alkaline cleaning composition produces an adherent foam cleaning composition having a viscosity of less than 300 centipoise which provides cleaning efficacy, rinseability, and surface adherence, wherein the foam stabilizing composition comprises an emulsified vinyl polymer effective in providing an adherent foam.

In accordance with an additional aspect of the invention, there is provided an adherent low viscosity foam cleaning composition which comprises a foam stabilizing composition of the invention combined with an alkaline cleaning composition such as a caustic cleaner, alkaline halogen cleaner, or solvated halogen cleaner.

In accordance with a further aspect of the invention, there is provided a method of cleaning surfaces comprising the step of applying an adherent low viscosity foam cleaning composition to the intended surface. In accordance with a further aspect of the invention, there is provided a cleaned surface resulting from use of the composition of the invention.

The composition of the invention comprises an alkali stable emulsified vinyl polymer, and once combined with an alkaline cleaning agent displays foam stabilizing properties resulting in a long lasting foam having adhesion to vertical surfaces. The long lasting foam permits the source of alkalinity in the cleaner to contact the soil for an extended period, and as a result, to promote the removal of soil. The foam is easily rinsed after sufficient time for removal of soil. The resulting foam composition allows application of the composition for extended periods of time allowing for the significant cleaning of vertical surfaces.

The invention may be used in conjunction with existing alkaline detergents to produce a stabilized foam which is capable of clinging to vertical and horizontal surfaces for extended time periods in excess of one hour without drying, and ultimately rinse freely with water. The invention overcomes the short comings of detergent systems by providing extended contact time (up to three hours on vertical surfaces), a highly visible stable foam, as well as providing a non-drying/free rinsing detergent.

DETAILED DESCRIPTION OF THE PREFERRED EMBODIMENTS

The invention is a method of stabilizing alkaline foam cleaners using a low viscosity vinyl polymer emulsion. Once combined with a cleaning composition, the invention also comprises a low viscosity foam stabilized cleaning composition as well as methods of using this composition and the cleaned surfaces resulting therefrom. By low viscosity is meant a viscosity of less than 300 centipoise.

Foam Stabilizing Composition

The foam stabilizer of the invention comprises an emulsified polymer or copolymer matrix. The polymer matrix generally provides a wet film strengthening of the foam. This stabilizing composition provides adherence to the foam as well as lowering the flow characteristics of the foam. As a result, the stabilized foam is capable of adhering without flow, on non-horizontal surfaces. Further, the polymeric matrix assists in entraining air in the foam of the invention. This entrained air, in turn, assists in providing adhesive character to the claimed composition. Further, the entrained air also assists in the breakdown of the foam once removal is desired.

In accordance with the invention, any number of vinyl compounds or monomers may be used to prepare the polymer or copolymer matrix used in the invention. Generally, vinyl polymers useful in the invention include polymers derived from vinyl acetals, vinyl acetates, vinyl alcohols, vinyl chlorides, vinyl ether monomers and polymers, n-vinyl monomers and polymers, vinyl fluorides, and the like.

Especially useful are vinyl polymers prepared from acrylic acid and its derivatives. Acrylic acid ($CH_2{=}CHCO_2H$) is a moderately strong carboxylic acid which is colorless liquid with an acrid odor. Generally acrylates are derivatives of both acrylic and methacrylic acid. Acrylic polymers and copolymers which may be used in the composition of the invention include alkyl acrylates such as methacrylate, ethylacrylate, propylacrylate, isopropylacrylate, and butylacrylate, sesquibutylacrylate, isobutylacrylate, tertbutylacrylate, hexylacrylate, heptylacrylate, 2-heptylacrylate, 2-ethylhexylacrylate, 2-ethylbutylacrylate, dodecylacrylate, hexadecylacrylate, 2-ethoxyethylacrylate, cyclohexylacrylate, and mixtures thereof.

Other vinyl polymers which may be used include vinyl acyl ethyl polymers; n-vinyl amide polymers; styrene polymers including vinyl benzene polymers; vinyl butyryl polymers including vinyl acetyl polymers; vinyl carbazole polymers; vinyl ester polymers including vinyl acetate polymers, as well as other vinyl esters of normal saturated aliphatic acids including formic, propanoic, butyric, valeric, caproic, and the like; vinyl esters of aromatic acids including benzoic, chlorobenzoic, nitrobenzoic, cyanobenzoic, and naphthoic; as well as vinyl ether polymers.

Hydrophilic monomers may also be utilized to produce the vinyl polymer in of the invention include acids and acid-esters of alpha, beta-unsaturated carboxylic acids such as methacrylic acid, acrylic acid, itaconic acid, aconitic acid, crotonic acid, mesaconic acid, carboxyethyl acrylic acid, maleic acid, fumaric acid and the like.

Synthetic polymers resulting from polymerization of many of the preceding monomers which are useful as foaming agents in the invention include generally, polyvinyl alcohol (with varying degrees of hydrolysis), ethylene/acrylic acid copolymers, ethylene/maleic anhydride copolymers, and styrene/maleic anhydride copolymers among others.

Naturally derivatized and naturally occurring polymers such as casein compositions, natural gum compositions including karaya gum and guar gum, cellulosic and ether cellulosic compositions, starch, protein compositions, and starch-grafted copolymers are also useful as a foaming polymer of the present invention. Those skilled in the art will realize that the preceding compounds and polymers are only exemplary of compounds and polymers which may be used as foam stabilizing agents in the composition of the present invention and this list should not be viewed as limiting.

Preferably, the vinyl polymer comprises a polyacrylate/polymethacrylate copolymer available from Rohm & Haas as Acusol 820 or Alcogum -SL70 available from Alco chemical. The concentration of the foaming polymer used in the foam stabilizing composition of the present invention will generally range from about 1.0 to 95 wt-%, preferably range from about 2.0 to 85 wt-%, and most preferably range from about 5.0 to 75 wt-% depending on the characteristics to be imparted to the resulting foam.

The foam stabilizing composition of the invention may also comprise any number of other adjuvants, such as alkalinity sources, sanitizers, and the like.

Any number of chemical agents having microbial efficacy may be used as a sanitizer in the foam stabilizing composition. Representative as antimicrobial agents in the invention include commonly available aldehydes such as formaldehyde and glutaraldehyde; iodophors such as iodine-nonionic surfactant complexes, iodine-polyvinyl pyrrolidone complexes, iodine-quaternary ammonium chloride complexes and amphoteric iodine-amine oxide complexes and the like; organic chlorine releasing agents such as cyanurates, cyanuric acids, and dichlorocyanuric dihydrates which are commercially available from FMC and Monsanto as their CDB and ACL product lines, respectively; fatty acids such as decanoic acid and the like; anionic surfactants such as dodecylbenzene sulfonic acid and sodium 1-octane sulfonate; phenols such as o-phenylphenol, 2,4,5-trichlorophenol, and 2,3,4,6-tetrachlorophenol commercially available from sources such as Dow Chemical Company and Mobay Chemical Company.

Also useful as antimicrobials in the invention are cationic surfactants including quaternary ammonium chloride surfactants such as N-alkyl($C_{12-18}$) dimethylbenzyl ammonium chloride, N-alkyl($C_{14-18}$) dimethylbenzyl ammonium chloride, N-tetradecyldimethylbenzyl ammonium chloride monohydrate, N-alkyl($C_{12-14}$) dimethyl 1-naphthylmethyl ammonium chloride available commercially from manufacturers such as Stepan Chemical Company.

When present, an antimicrobial agent must have a concentration effectively necessary for the required sanitizing action to be provided. Generally, the concentration of antimicrobial agent may range from about 0.005 to 0.5 wt-%, preferably from about 0.05 to 0.4 wt-%, and most preferably from about 0.1 to 0.3 wt-%. Preferably, the antimicrobial agent comprise a mixture of sorbic acid and benzoic in the foam stabilizing composition at a concentration of about 0.05 wt-% and 0.15 wt-%, respectively.

In preparation, the vinyl polymer emulsion may be combined with a source of alkalinity such as a hydroxide salt, carbonate, phosphate, amine or mixture thereof. The purpose of the alkalinity source is to neutralize the often acidic character of the vinyl polymer and reduce the amount of alkalinity scavenged from the alkaline cleaner composition with which the foam will later be combined. The foam may be neutralized with any number of alkalinity sources, including those disclosed below, to attain a pH of about 4 to 6, preferably about 4 to 5.5, and most preferably about 4.5 to 5.5.

Once neutralized a preservative system may be introduced into the composition along with any other adjuvants desired for use in the foam or cleaner. A summary of concentrations for the foam is provided below in Table 1.

TABLE 1

| | (Wt-% as a percentage of foam stabilizing composition) | | |
|---|---|---|---|
| | useful | working | preferred |
| Vinyl Polymer Emulsion | 1–95 | 2–85 | 5–75 |
| Alkalinity (pH) | 4–6 | 4–5.5 | 4.5–5.5 |
| Antimicrobial | 0.025–0.5 | 0.05–0.4 | 0.1–0.3 |
| Water | q.s | q.s | q.s. |

Alkaline Cleaning Compositions

The foam stabilizing additive may be used in combination with any number of cleaning compositions such as alkaline or caustic cleaners, halogenated alkaline cleaners, and solvated alkaline cleaners among others. Alkaline or caustic cleaners may be based upon any number of alkali or alkaline earth metal hydroxides, such as for example sodium hydroxide (caustic).

In order to achieve an alkaline pH, the cleaning composition generally requires an alkalinity source. This higher pH increases the efficacy of soil removal and sediment breakdown when the chemical is placed in use and further facilitates the rapid dispersion of soils.

The source of alkalinity also functions to raise the pH of the foam of the invention. The effect of this pH increase is to completely neutralize the vinyl polymer, releasing it from the emulsion and combining with the detergent to stabilize a foam capable of adhering to horizontal and vertical surfaces for extended periods of time.

The general character of the alkalinity source is limited only to those chemical compositions which have a greater solubility. That is, the alkalinity source should not contribute metal ions which promote the formation of precipitates or film salts. Exemplary alkalinity sources include silicates, hydroxides, phosphates, amines, and carbonates. Amines useful in accord with this invention include monoethanol, diethanol, and triethanol amines. Generally, when an amine compound is used or the alkalinity source, the concentration of the amine may range from about 0.10 wt-% to 5 wt-%, preferably from about 0.10 wt-% to 4.5 wt-%, and most preferably from about 0.25 wt-% to 3 wt-%.

Silicates useful in accord with this invention include alkaline metal ortho, meta-, di-, tri-, and tetrasilicates such as sodium orthosilicate, sodium sesquisilicate, sodium sesquisilicate pentahydrate, sodium metasilicate, sodium metasilicate pentahydrate, sodium metasilicate hexahydrate, sodium metasilicate octahydrate, sodium metasilicate nanohydrate, sodium disilicate, sodium trisilicate, sodium tetrasilicate, potassium metasilicate, potassium metasilicate hemihydrate, potassium silicate monohydrate, potassium disilicate, potassium disilicate monohydrate, potassium tetrasilicate, potassium, tetrasilicate monohydrate, or mixtures thereof.

Generally, when a silicate compound is used as the alkalinity source in the invention, the concentration of the silicate will range from about 0.5 wt-% to 8 wt-%, preferably from about 0.5 wt-% to 5 wt-%, and most preferably from about 0.5 wt-% to 3 wt-%.

Alkali metal hydroxides have also been found useful as an alkalinity source in the invention. Alkali metal hydroxides are generally exemplified by species such as potassium, sodium, and lithium hydroxide salts as well as other alkali hydroxide salts. Mixtures of these species may also be used. When present, the alkaline hydroxide concentration generally ranges from about 0.25 wt-% to 10 wt-%, preferably from about 0.5 wt-% to 8 wt-%, and most preferably from about 1 wt-% to 5 wt-%.

An additional source of alkalinity includes carbonates. Alkali metal carbonates which may be used in the invention include sodium carbonate, potassium carbonate, sodium or potassium bicarbonate, or sesquicarbonate, among others. Preferred carbonates include sodium and potassium carbonates. When carbonates are used, the concentration of these agents generally ranges from about 0.5 wt-% to 12 wt-%, preferably from about 1 wt-% to 10 wt-%, and most preferably from about 1.5 wt-% to 8.5 wt-%.

Phosphates which may be used as an alkalinity source in accordance with the invention include cyclic phosphates such as sodium or potassium orthophosphate, alkaline condensed phosphates such as sodium or potassium pyrophosphate, sodium tripolyphosphate, sodium hexametaphosphate, and the like. In using phosphates, the concentration will generally range from about 1 wt-% to 20 wt-%, preferably from about 1 wt-% to 10 wt-%, and most preferably from about 2 wt-% to 8 wt-%.

Halogenated alkaline cleaners may comprise any number of alkalinity sources such as those useful with the adherent foam of the invention. In addition to providing cleaning efficacy, halogens may be used to disinfect, sanitize or otherwise enhance the antimicrobial character of the surface of application. Additionally, a halogen source may also be present such as chlorine, bromine, iodine, or fluorine among others.

Another cleaning composition with which the foam of the invention may be used is solvated (organic) cleaners having an organic character. Generally, organic solvents function to dissolve, suspend, or otherwise charge the physical properties of materials intended to be removed by the cleaners. Exemplary families of organic solvents include amines, olephinic compounds, short chain and long chain carboxylic acids, and alcohols including mono-, di-, and tri-functional alcohols among other compounds. Again any of the alkalinity sources mentioned earlier may be used with the invention. Organic cosolvents preferred for use in these compositions include mono-, di-, and polyfunctional alcohols. A summary of the concentrations, of the combined alkaline cleaning compositions and foam stabilizing composition may be found in Table 2.

TABLE 2

| | (Wt-% as a percentage of total cleaning composition) | | |
|---|---|---|---|
| | useful | working | preferred |
| foam stabilizing composition | 1.0–10.0 | 1.50–9.0 | 2.0–8.0 |
| alkaline cleaning composition | 0.05–20.0 | 0.05–18.0 | 0.1–15.0 |
| water | q.s. | q.s. | q.s. |

The compositions are prepared separately and either mixed just prior to foam application or mixed through a dual-feed aspirator as the foam is generated. For example, single and multiple container foam applicators like Klenzade Model K and SUPERFOAMER available from Ecolab Inc may be used. The resulting adherent foam cleaning composition has a pH range anywhere from about 6.0 to 14.0.

WORKING EXAMPLES

The invention will be further described by reference to the following detailed examples.

Foam Stabilizing Composition

A foam stabilizing composition was formulated having the following constituents and concentration.

FORMULA 1

| Raw Material | Wt % |
|---|---|
| Distilled water | 49.50 |
| NaOH (50% w/v) | 0.20 |
| Sorbic acid | 0.05 |
| Benzoic acid | 0.15 |
| Hidacid Pyranine dye, (CI #59040) | 0.10 |
| Acrylic Copolymer emulsion* | 50.0 |

*(Acusol 820-Rohm and Haas Co, or Gum SL-70 Alco Chemical Co.)

Various alkaline cleaning compositions were then formulated as seen by Detergent Compositions A through E.

Detergent Composition A

| Percent (Wt-%) | Raw Material |
|---|---|
| 32.30 | Soft Water |
| 0.10 | EDTA |
| 31.20 | Sodium Hydroxide 50% (w/v) |
| 6.40 | Organic chelant |
| 30.00 | Sodium Hypochlorite |

Detergent Composition B

| Percent (Wt-%) | Raw Material |
|---|---|
| 89.20 | Sodium Hydroxide (50% w/v) |
| 4.35 | Soft Water |
| 0.75 | Nonionic Surfactant |
| 0.10 | Organic Chelant |
| 5.60 | 40% Sodium Gluconate |

Detergent Composition C

| Percent (Wt-%) | Raw Material |
|---|---|
| 51.70 | Deionized Water |
| 1.40 | Organic Chelant |
| 40.00 | Sodium hydroxide 50% |
| 1.00 | Nonionic surfactant |
| 2.00 | Amine Oxide |
| 4.00 | Amphoteric surfactant |

Detergent Composition D

| Percent (Wt-%) | Raw Material |
|---|---|
| 69.9 | Soft Water |
| 1 | Versene 100 (EDTA) |
| 7.5 | TKPP, 60% (w/v) |
| 1.6 | NaOH, 50% (w/v) |
| 1 | Sodium Metasilicate, Anhy. |
| 3 | Anionic Surfactant |
| 5 | Nonionic Surfactant |
| 3 | Phosphate Ester |
| 8 | Glycol Ether |

Detergent Composition E

| Raw Material | Wt % |
|---|---|
| 50% NAOH | 96.45 |
| 50% Gluconic acid | 2.50 |
| Soft Water | 1.00 |
| Nonionic Surfactant | 0.05 |

The foam stabilizing composition was then combined with the various Detergent Compositions (A through E) and tested.

The following compositions were added to a fifteen gallon foam application pressure vessel, which is a fifteen gallon capacity stainless steel pressure vessel with mix propeller. The solutions were stirred while the components were added. This type of tank foamer is able to dispense standard foam cleaning products of low viscosity or much more viscous solutions, such as gels, if necessary.

Working Example 1

Foam stabilizing Composition with Detergent Composition A.

In the fifteen gallon foam application pressure vessel, 1,136 grams of Formula 1 was mixed with 17,059 grams of Soft Water. To this mixture was added, while stirring, 730.0 grams of detergent composition A containing over 10% NaOH and over 3% sodium hypochlorite. The vessel was pressurized to 63 p.s.i. and the air-liquid controls adjusted to ¼ turn open air—1 and ½ turns open liquid. The resulting air-solution combination was applied to vertical stainless steel walls as a rich foam with a finished thickness of 0.5–0.25 inches. This foam did not flow off the wall, but instead remained as applied without collapse for ten minutes. After forty minutes the foam still provided 100% coverage of the area to which it was applied with only slight collapse. At this time, the foam was rinsed off with cold water at low pressure and the Foam was found to rinse off easily and completely.

Working Example 2

Foam stabilizing composition with Detergent Composition B.

In the fifteen gallon foam application pressure vessel 1,510 grams of Formula 1 was combined with 15,900 grams soft water. To this mixture was added, while stirring 1,510 grams of Detergent Composition B with over 40% NaOH, a nonionic surfactant and chelating agents. The vessel was pressurized to 63 p.s.i. with air and the air-liquid controls adjusted to 1 and ½ turns open liquid and ¼ turn open air. The resulting air-solution combination was applied to vertical stainless steel walls as a dry foam with a finished thickness of 1.0–1.5 inches.

This foam did not flow off the wall, but instead remained as applied without collapse for ten minutes with 100% coverage of the wall at this time. At 15 minutes after application the areas with a 1.5" thick foam coating had sagged slightly but the wall remained 100% covered by the foam. At 20 minutes after application the foam had sagged sufficiently to clear 10% of the stainless steel wall of foam but the remainder of the wall was still coated. This foam was rinsed off with low pressure cold water and the foam was found to rinse easily and completely at this time.

Working Example 3

Foam stabilizing composition with Detergent Composition C.

With a dual intake wall mounted foam unit (Model K low pressure/standard pressure produced by Ecolab Incorporated) the combination of Formula 1 with a highly alkaline self foaming detergent with a blend of amphoteric surfactants and a level of NaOH in excess of 15% was tested for dynamic mixing and production of the stable alkaline foam. The unit operated by allowing a flow of water through a venturi to aspirate concentrated products into the stream of water and subsequent to their mixing injects air under pressure into the fluid stream. With a concentration of Formula 1 equivalent to 7.5% and 1.6% of the Detergent Composition C determined by flow rate of the water and draw rate of the concentrates, the unit Model K LP/SP produced a very thick clinging foam on vertical stainless steel walls which did not flow off the walls upon application. After 75 minutes the foam was found to be still 80% as foam with 20% collapsed but 100% coverage of the application area. The foam was easily rinsed off with low pressure hot water rinse (130 degrees F.).

Working Example 4

Foam stabilizing composition with Detergent Composition D.

In the fifteen gallon foam application pressure vessel 570 grams of Formula 1 was mixed with 17,700 grams of soft water. To this mixture was added, with stirring, 630 grams of Detergent Composition D with a water soluble solvent, anionic and nonionic surfactants. The vessel was pressurized to 62 p.s.i. and the air-liquid controls adjusted to 1 and ½ turns open liquid, ⅛ turn open air. The resulting air-liquid combination was applied to stainless steel walls as a very wet foam which did not flow off the wall but instead flowed to an even foam coating of ⅛ inch thick. At 10 minutes after foam application there was no change in foam appearance with 100% coverage of stainless steel wall surface. At thirty minutes after foam application, a slight thinning of foam thickness was visible but the stainless steel wall surface was still coated 100% by the foam. Foam rinsed with low pressure cold water at this time. The foam was easily rinsed off.

Working Example 5

Foam stabilizing composition with Detergent Composition E.

In the fifteen gallon foam application pressure vessel 1,140 grams of Formula 1 was mixed with 15,830 grams soft water. To this mixture was added, while stirring, 1,960 grams of a Detergent Composition E with NaOH content in excess of 45% NaOH. The vessel was pressurized to 63 p.s.i. and the air-liquid controls adjusted to ¼ turn open air and 2 turns open liquid. The resulting air-solution combination was applied to vertical stainless steel walls with a finished thickness of 1–2 inches. At 15 minutes after application there was 100% coverage with no change in foam appearance. At 25 minutes after application of the foam 95% of the area was covered with the remaining foam having slid to the floor. The foam rinsed easily with cold water low pressure rinse.

Comparative Example 1

The following example illustrates the performance of an alkaline foaming detergent without the addition of the foam stabilizing composition of the present invention.

In the fifteen gallon foam application pressure vessel 1,890 grams of a detergent composition C was combined with 17,030 grams of soft water, the solution was stirred to mix. The vessel was pressurized to 63 p.s.i. with air and the air-liquid controls adjusted to 1 and ½ turns open liquid and ⅛ turn open air. The resulting air-solution combination was applied to vertical stainless steel walls. The foam produced was thick and wet and immediately upon application began to flow downward. At 10 minutes after application of the foam to the wall 95% of the wall was clear of any foam coating and the remaining area had a thin coating of foam. At fifteen minutes the 5% of the wall which had a thin foam coating at 10 minutes was coated with film without foam characteristics.

Comparative Example 2

| (2) Material | Weight % | Weight |
|---|---|---|
| Soft water | 93.30 | 17,657 gr |
| Acusol 820 | 1.50 | 283.9 gr |
| 50% NaOH | 4.95 | 935.7 gr |
| Dequest 2000 | 0.25 | 47.3 gr |

In the fifteen gallon foam application pressure vessel the above mixture was prepared.

The air pressure was set for a tank pressure of sixty-five pounds per square inch. The air injection control was set a one-fourth turn open. The liquid flow control was set at two turns open. The solution was applied to the stainless steel panel walls of a foam application test room. The above solution was applied with a standard foam nozzle, which is an open steel tube three-eights of an inch in diameter. The above solution produced a rich, wet foam which adhered to the stainless steel wall with an average thickness of one-fourth inch. The foam's appearance was observed for one hour. After one hour, a maximum of two percent of the foam had slid from its original position and only a slight drop in foam thickness was observed. At this time, a low pressure water rinse was applied. The foam rinsed off easily with this type of procedure.

The viscosity of the solution from comparative example 2, solution (2) was checked with a Brookfield LVT viscometer at 70° F. with spindle Cl at a setting of sixty rpm. Three readings were taken and their values averaged. Solution (2) gave viscosity value of 3 centipoise.

Comparative Example 3

| (3) Material | Weight % | Weight |
|---|---|---|
| Soft water | 87.9 | 16,633 gr |
| Acusol 820 | 4.0 | 757 gr |
| High Alkaline detergent | 7.2 | 1,366 gr |
| Sodium Hypochlorite solution –8% available chlorine | 0.9 | 168 gr |

High alkaline detergent: Contains forty-five percent sodium hydroxide, surfactants, and water hardness treatment chemicals.

In the fifteen gallon foam application pressure vessel, the above mixture was prepared.

The air pressure was set at sixty-five pounds per square inch. The air injection control was set at one-fourth turn open. The liquid flow control was set full open. The above solution was applied with a standard foam nozzle. This solution produced a thick, rich foam which averaged three-eighths of an inch thick. This foam adhered to the wall for fifteen minutes with one hundred percent coverage. At twenty-five minutes, ninety-five percent of the area initially coated remained in place. At thirty-five minutes after initial application, twenty percent of the formerly coated area was open due to foam movement. The wall was rinsed with low pressure water at this time. The foam was easily rinsed with this type of procedure.

The viscosity of the solution from comparative example (3) was obtained with a Brookfield LVT, Spindle Cl with a setting of twelve rpm. With the solution temperature adjusted to 70° F., three viscosity readings were taken and their values averaged. Solution (3) gave a viscosity value of 274 centipoise.

Comparative Example 4

| Material | Weight % | Weight |
|---|---|---|
| Soft water | 92.70 | 17,540 g |
| Acusol 820 | 3.00 | 568 g |
| Chlorinated alkaline detergent | 1.00 | 189 g |
| Sodium Hypochlorite solution –8% available chlorine | 0.9 | 168 g |
| High Alkaline detergent | 2.4 | 460 g |

Chlorinated alkaline detergent: Contains eleven percent potassium hydroxide, two percent potassium hypochlorite, surfactants, and water hardness treatment chemicals.

High alkaline detergent: Contains forty-five percent sodium hydroxide, surfactants, and water treatment chemicals.

In the fifteen gallon foam application pressure vessel, the above mixture was prepared.

The air pressure was adjusted to sixty-three pounds per square inch. The air injection control was set to one-eighth turn open. The liquid control was set to full open. The composition was applied with a standard foam nozzle. The solution was applied as a wet foam with a thickness of one-fourth inch which adhered to the stainless steel wall. At thirty minutes, ten percent of the originally coated foam area was bare. The wall was rinsed with low pressure water at this time. The foam rinsed off easily with this procedure.

The viscosity of the solution of comparative example (4) was obtained with a Brookfield LVT, Spindle Cl with a setting of sixty rpm. The solution temperature was adjusted to 70° F. Three viscosity readings were taken and their values averaged. Solution (4) gave a viscosity value of 41 centipoise.

Comparative Example 5

| Material | Weight % | Weight |
|---|---|---|
| Soft water | 76.2 | 7,620 g |
| Acusol 820 | 3.3 | 330 g |
| Triton X-100 | 0.5 | 50 g |
| 50% NaOH | 20.0 | 2,000 g |

In the fifteen gallon foam application pressure vessel, the above mixture was prepared.

The air pressure was adjusted to fifty pounds per square inch. The liquid control was opened one and one-half turns. The composition was applied with a standard foam nozzle. The air injection control was adjusted from one-sixteenth to one-half turn open, but no setting was found which produced a foam. The solution was applied as a thin, white film less than a sixteenth of an inch thick. At twenty minutes, there was no sign of drying. After forty minutes, ten percent of the application area was dry (along top and sides of application area). At one hour, twenty percent of the solution was a smearable film, essentially dried.

The remaining coating was a thin, moist layer. The wall was rinsed with a low pressure water at this time. The area that had dried to a smearable film required in excess of two minutes direct water rinse to rehydrate. The remainder of application area with a moist film rinsed easily.

The viscosity of the solution from comparative example (5) was obtained with a Brookfield LVT, Spindle Cl with a setting of three rpm. The solution temperature was adjusted to 70° F. Three viscosity readings were taken and their values were averaged. Solution (5) gave a viscosity value of 1210 centipoise.

Comparative Example 6

| Material | Weight % | Weight |
|---|---|---|
| Soft water | 74.5 | 7,450 g |
| Acusol 820 | 5.0 | 500 g |
| Triton X-100 | 0.5 | 50 g |
| 50% NaOH | 20.0 | 2,000 g |

In the fifteen gallon foam application pressure vessel, the above mixture was prepared.

The air pressure was adjusted to fifty pounds per square inch. The liquid control was opened one and one-half turns. The composition was applied with a standard foam nozzle. The air injection control was adjusted but no setting was found which produced a foam. The solution was applied as a spray with continual sputtering and atomization creating a mist in air. The solution splattered as applied, eventually producing a white film one-sixteenth of an inch thick. At twenty minutes, there was no sign of drying and one hundred percent coverage. At one hour, five percent around sides and top of application area had dried, the remaining ninety-five percent was moist. Rinse with low pressure water at one hour. This solution's film is considerably harder to rinse than any previous solution. The moist areas rinse easier than the dry, but all areas require extensive rinsing to remove, requiring approximately ten minutes total.

The viscosity of the solution of comparative example (6) was obtained with a Brookfield LVT, Spindle C3 with a setting of three rpm. The solution temperature was adjusted to 70° F. Three viscosity readings were taken and their values were averaged. Composition (6) gave a viscosity of 15,400 centipoise.

In summary, solutions (2), (3) and (4) are low viscosity solutions ((2) 3 centipoise, (3) 274 centipoise and (4) 41 centipoise) which are easily applied as foams which adhere well to stainless steel vertical surfaces. These are solutions which also are easily rinsed off an application area up to one hour after initial application.

Solutions (5) and (6) are typical examples cited in the Acusol 820 product brochure. These solutions have high viscosities ((5) 1210 centipoise and (6) 15,400 centipoise) and are not able to be applied as a foam. These solutions do adhere to vertical stainless steel surfaces and remain over eighty percent moist at one hour. Both solution (5) and solution (6) require much more water, time and effort to rinse after one hour application time.

The above discussion, examples and data illustrate our current understanding of the invention. However, since many variations of the invention can be made without departing from the spirit and scope of the invention, the invention resides wholly in the claims hereinafter appended.

We claim as our invention:

1. A method of preparing an adherent foam cleaning composition comprising adding a foam stabilizing composition, said foam stabilizing composition comprising an amount of an alkalinity source sufficient to attain a pH between about 4.5 and 5.5 in said foam stabilizing composition, from about 1.0 wt-% to 95 wt-% of a vinyl acrylic polymer emulsion, from about 0.1 wt-% to 0.3 wt-% of an antimicrobial agent and a balance of water, to an alkaline cleaning composition to provide said adherent foam cleaning composition having a viscosity of less than 300 centipoise.

2. The method of claim 1 wherein said alkalinity source comprises an alkali or alkaline earth metal hydroxide.

3. The method of claim 1 wherein said alkalinity source is selected from the group consisting of a hydroxide, a phosphate, a carbonate, a silicate, an amine, and mixtures thereof.

4. The method of claim 1 wherein the resulting adherent foam cleaning composition has a pH of about 6.0 to 14.0.

5. The method of claim 1 wherein said vinyl acrylic polymer emulsion comprises one or more acrylic monomers selected from the group consisting of methylacrylate, ethylacrylate, propyl acrylate, isopropylacrylate, butylacrylate, sesquibutylacrylate, isobutylacrylate, tertbutylacrylate, hexylacrylate, heptylacrylate, 2-heptylacrylate, 2-ethylhexylacrylate, 2-ethylbutylacrylate, dodecylacrylate, hexadecylacrylate, and 2-ethoxyethyl acrylate.

6. The method of claim 1 wherein said vinyl acrylic polymer emulsion comprises an ester of an alpha, beta-unsaturated carboxylic acid.

7. The method of claim 6 wherein said alpha, beta-unsaturated carboxylic acid ester is selected from the group consisting of a methacrylic acid ester, an acrylic acid ester, an itaconic acid ester, an aconitic acid ester, a crotonic acid ester, a mesaconic acid ester, a carboxyethyl acrylic acid ester, a maleic acid ester, a fumaric acid ester, and mixtures thereof.

8. A method of preparing an adherent foam cleaning composition comprising adding a foam stabilizing composition, said foam stabilizing composition comprising an amount of alkalinity source sufficient to attain a pH between about 4.5 and 5.5 in said foam stabilizing composition, from about 1.0 wt-% to 95 wt-% of a vinyl polymer emulsion, from about 0.1 wt-% to 0.3 wt-% of an antimicrobial agent and a balance of water, to an alkaline cleaning composition to provide said adherent foam cleaning composition having viscosity of less than 300 centipoise.

9. The method of claim 8 wherein said vinyl polymer emulsion comprises one or more acrylic monomers.

10. The method of claim 8 wherein said vinyl polymer emulsion comprises one or more monomers selected from the group consisting of a vinyl acetal monomer, a vinyl acetate monomer, a vinyl alcohol monomer, a vinyl chloride monomer, a vinyl ether monomer, an n-vinyl monomer, and a vinyl fluoride monomer.

11. The method of claim 9 wherein said acrylic monomers are selected from the group consisting of acrylate, methylacrylate, ethylacrylate, propyl acrylate, isopropylacrylate, butylacrylate, sesquibutylacrylate, isobutylacrylate, tertbutylacrylate, hexylacrylate, heptylacrylate, 2-heptylacrylate, 2-ethylhexylacrylate, 2-ethylbutylacrylate, dodecylacrylate, hexadecylacrylate, and 2-ethoxyethyl acrylate.

12. The method of claim 8 wherein said vinyl polymer emulsion comprises an ester of an alpha, beta-unsaturated carboxylic acid.

13. The method of claim 12 wherein said alpha, beta unsaturated carboxylic acid ester is selected from the group consisting of a methacrylic acid ester, an acrylic acid ester, an itaconic acid ester, an aconitic acid ester, a crotonic acid ester, a mesaconic acid ester, a carboxyethyl acrylic acid ester, a maleic acid ester, a fumaric acid ester, and mixtures thereof.

14. A method of cleaning hard surfaces, said method comprising the steps of:

(i). adding a foam stabilizing composition, said foam stabilizing composition comprising:

(a) from about 1.0 wt-% to 95 wt-% of a vinyl acrylic polymer emulsion;

(b) an amount of alkalinity source effective to raise the pH of said foam stabilizing composition to about pH 4.5 to 5.5;

(c) from about 0.1 wt-% to 0.3 wt % of an antimicrobial agent; and (d) a balance of water, to an alkaline cleaning composition to provide an adherent foam cleaning composition having a viscosity less than 300 centipoise, and;

(ii). applying to said surfaces with a foam nozzle said adherent foam cleaning composition.

15. The method of claim 14 wherein said alkalinity source is selected from the group consisting of a hydroxide, carbonate, silicate, phosphate, an amine, and mixtures thereof.

16. A method of cleaning hard surfaces, said method comprising the steps of:

(i) adding a foam stabilizing composition, said foam stabilizing composition comprising:

(a) from about 1.0 to 95 wt-% vinyl polymer emulsion;

(b) an amount of alkalinity source effective to raise the pH of said foam stabilizing composition to about pH 4.5 to 5.5; and (c) a balance of water, to an alkaline cleaning composition to provide an adherent foam cleaning composition having a viscosity of less than 300 centipoise, and (ii) applying to said surfaces with a foam nozzle said adherent foam cleaning composition.

17. An adherent foam cleaning composition comprising:

(a) an amount of a halogenated alkaline cleaner effective in the removal of soil; and (b) a foam stabilizing composition consisting essentially of:

(i) an amount of alkalinity source effective to raise the pH of said foam stabilizing composition to between about 4.5 and 5.5;

(ii) from about 1.0 wt-% to 95 wt-% of vinyl polymer emulsion;

(iii) from about 0.1 wt-% to 0.3 wt-% of an antimicrobial agent; and (c) a balance of water, said adherent foam cleaning composition has a viscosity of less than 300 centipoise.

18. The adherent foam composition of claim 17 comprising from about 0.05 to 20.0 wt-% halogenated alkaline cleaner.

19. The adherent foam composition of claim 17 comprising from about 1.0 wt-% to 10.0 wt-% foam stabilizing composition.

20. The adherent foam composition of claim 19 wherein said vinyl polymer emulsion consists essentially of one or more acrylic monomers.

21. The adherent foam composition of claim 19 wherein said vinyl polymer emulsion consists essentially of a polyacrylate-polymethacrylate copolymer emulsion.

22. An adherent foam cleaning composition comprising:

(a) from about 0.05 wt-% to 20.0 wt-% of a chlorinated alkaline cleaner effective in the removal of soil; and (b) from about 1.0 wt-% to 10.0 wt-% of a foam stabilizing composition comprising:

(i) an amount of alkalinity source effective to raise the pH of said foam stabilizing composition to between about 4.5 and 5.5; and (ii) from about 1.0 wt-% to 95 wt-% of vinyl acrylic polymer emulsion;

(iii) from about 0.1 wt-% to 0.3 wt-% of an antimicrobial agent; and (iv) a balance of water, wherein said adherent foam cleaning composition has a viscosity of less than 300 centipoise.

* * * * *